US007392981B2

(12) United States Patent
Hahn et al.

(10) Patent No.: US 7,392,981 B2
(45) Date of Patent: Jul. 1, 2008

(54) DEVICE FOR ALIGNING STACKED SHEETS INTO A BOOK

(75) Inventors: Thilo Hahn, Dettelbach (DE); Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 310 days.

(21) Appl. No.: 10/490,504

(22) PCT Filed: Sep. 17, 2002

(86) PCT No.: PCT/DE02/03459

§ 371 (c)(1),
(2), (4) Date: Aug. 26, 2004

(87) PCT Pub. No.: WO03/026992

PCT Pub. Date: Apr. 3, 2003

(65) Prior Publication Data

US 2005/0035537 A1 Feb. 17, 2005

(30) Foreign Application Priority Data

Sep. 24, 2001 (DE) ..... 101 46 919

(51) Int. Cl.
*B65H 31/08* (2006.01)

(52) U.S. Cl. ..... 271/212; 271/195; 271/197; 271/237; 271/309

(58) Field of Classification Search ..... 271/212, 271/211, 195, 197, 309, 3.23, 5, 3.11, 166, 271/237, 238
See application file for complete search history.

(56) References Cited

U.S. PATENT DOCUMENTS

| | | | | |
|---|---|---|---|---|
| 3,624,807 | A * | 11/1971 | Schwebel | 271/236 |
| 4,089,517 | A | 5/1978 | Marass | |
| 4,132,400 | A * | 1/1979 | Naramore | 271/221 |
| 4,369,959 | A | 1/1983 | Hornbuckle | |
| 4,570,918 | A | 2/1986 | Eisler | |
| 4,593,897 | A * | 6/1986 | Silverberg | 271/212 |
| 4,651,984 | A | 3/1987 | Emrich | |
| 5,080,344 | A * | 1/1992 | Hayashi | 271/107 |
| 5,951,007 | A * | 9/1999 | Greive et al. | 271/276 |
| 6,634,852 | B2 * | 10/2003 | Bakoledis | 414/789 |

FOREIGN PATENT DOCUMENTS

| | | | | |
|---|---|---|---|---|
| DE | 870 639 | C | 6/1953 | |
| DE | 68 09 156 | U | 9/1970 | |
| DE | 42 36 839 | A1 | 5/1994 | |
| DE | 198 27 531 | A1 | 12/1999 | |
| EP | 0 614 840 | A1 | 9/1994 | |
| JP | 2-75566 | A * | 3/1990 | 271/207 |

* cited by examiner

*Primary Examiner*—Patrick H. Mackey
*Assistant Examiner*—Jeremy R Severson
(74) *Attorney, Agent, or Firm*—Crompton, Seager & Tufte, LLC

(57) ABSTRACT

The invention concerns a device (01) for aligning at least along one edge several stacked sheets (09) into a book, while maintaining the serial order of sheets, said device comprising an editing table (11), having on one of its sides, a front stop (13) for aligning the edges of the sheets (09). The invention is characterized in that upstream of the editing table (11) is provided a support plate (02), whereon the sheet (09) can be set into a bound book with non-aligned edges, and is further provided in the device (01), a sheet feeder (08, 04, 06) whereby the sheets can be conveyed from the support plate (02) towards the front stop (13) of the editing table (11), while forming a stream of subjacent webs.

24 Claims, 4 Drawing Sheets

DEVICE FOR ALIGNING STACKED SHEETS INTO A BOOK

TECHNICAL FIELD

The invention relates to an apparatus for aligning sheets arranged one above the other in a stack in accordance with the preamble of claim 1 or 2.

BACKGROUND OF THE INVENTION

Such apparatuses are used for example, but in no way exclusively, for aligning printed sheets along at least one edge, with sufficient accuracy, one above the other, with the result that the stack can then be trimmed at the edges. In the case of a fair number of printed products, for example notes of value provided with registration numbers, it is necessary, once the sheets have been printed, to maintain the sequence of the sheets in the stack-forming pile.

EP 06 14 840 A1 discloses an apparatus which is designed in the manner of a vibrating table. A supporting table is provided for this vibrating table, lateral stops being arranged on at least two, adjacent sides of the supporting table and it being possible for these stops to come into abutment against the side edges of the sheets. In order to align the stack of sheets arranged one above the other, the stack is set down on the supporting table and the latter is then inclined in the direction of the two stops to the extent where the side edges of the sheets come into abutment against the stops on account of gravitational force. The vibrating table is then made to vibrate in order thus to loosen the stack of sheets and to allow an aligning movement of the individual sheets relative to one another.

DE 68 09 156 U discloses an apparatus which is intended for aligning items of mail and in the case of which an imbricated stream is aligned to form a stack.

U.S. Pat. No. 4,369,959 A discloses an apparatus for aligning an edge of a plurality of sheets arranged one above the other on a supporting table one side of which a leading-edge stop is arranged. The apparatus contains a sheet feeder, by means of which the sheets are conveyed to the leading-edge stop.

DE 42 36 839 A discloses a carrying plate on which the sheets are set down with non-aligned leading edges and are conveyed from the carrying plate to form an imbricated stream with underlap imbrication.

U.S. Pat. No. 4,570,918 A describes a blowing device which blows air between sheets from the trailing edges thereof.

DE 198 27 531 A1 discloses a feeder with two leading-edge stops and a side lay arranged on its table.

SUMMARY OF THE INVENTION

The object of the invention is to provide apparatuses for aligning sheets arranged one above the other in a stack.

The object is achieved according to the invention by the features of claim 1.

The advantages which can be achieved by the invention consist, in particular, in that the stack of sheets with non-aligned leading edges, rather than being set down directly on the supporting table, is set down on an upstream carrying plate. The apparatus here contains a sheet feeder, by means of which the sheets set down on the carrying plate are conveyed separately, and in the form of an imbricated stream, to the leading-edge stop of the supporting table. The sheet feeder here is to be designed such that an imbricated stream with underlap imbrication forms, i.e. the leading edge of each sheet is conveyed in each case beneath the respectively preceding sheet, with the result that, rather than the pile having to be restacked from the carrying plate in the direction of the supporting table, the sequence of the sheets is maintained. Since the sheets in each case are individually conveyed to the leading-edge stop and aligned there, a high level of aligning accuracy is achieved. The design of the apparatus may include the use, in slightly modified form, of known sheet feeders as are used for feeding sheets separately into a sheet-printing machine. In order to modify the design of known sheet feeders, a leading-edge stop has to be provided, in particular, on the supporting table, in the plane of which the imbricated stream is conveyed.

BRIEF DESCRIPTION OF THE DRAWINGS

Exemplary embodiments of the invention are described in more detail hereinbelow and illustrated in the drawings, in which.

DETAILED DESCRIPTION OF THE PREFERRED EMBODIMENTS

Figure 1:
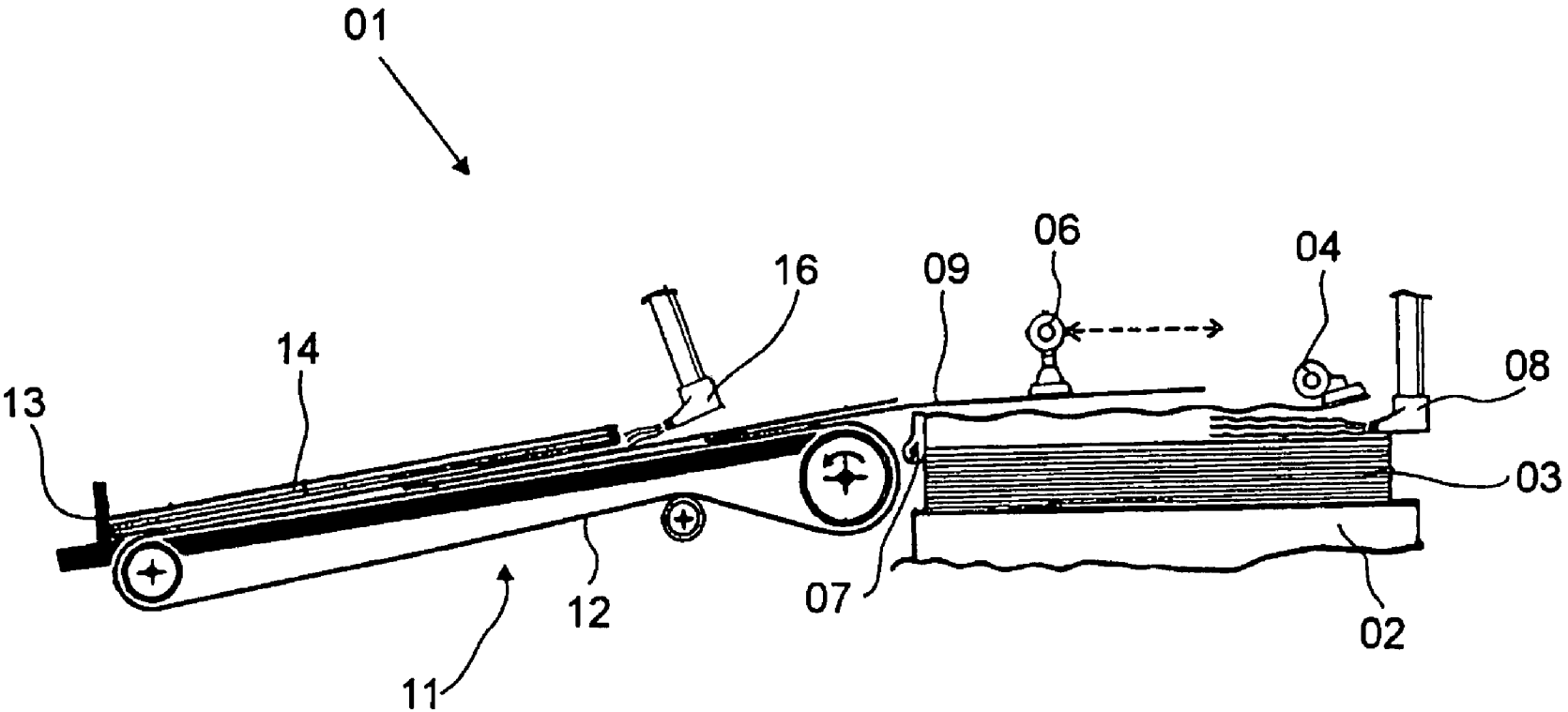
FIG. 1 shows a first exemplary embodiment of an apparatus in a schematically illustrated side view.

The production of the apparatus 01 illustrated in FIG. 1 may be based on a conventional sheet feeder as is used for feeding sheets separately into a sheet-printing machine.

Such sheet feeders have a carrying plate 02, on the top side of which the sheets 09 can be set down in a stack 03 with sheets 09 in which at least one side edges has not been yet aligned. By means of the suckers 04; 06 and the pressure-exerting foot 08 with integrated air nozzle, the sheets 09 are conveyed separately from the stack 03 in the direction of the supporting table 11. The supporting table 11 here is designed in the manner of a suction-belt table 11 with circulating suction belts 12.

Use of the suckers 04; 06, of the stop 07, of the pressure-exerting foot 08 and of the suction belts 12 results in the sheets 09 being conveyed from the carrying plate 02 in the direction of the supporting table 11 in the form of an imbricated stream with underlap imbrication. Arranged at the rear end of the supporting table 11, as seen in the conveying direction of the sheets 09, is a leading-edge stop 13, against which the leading edges of the sheets 09 are conveyed by the advancement movement of the suction belts 12 and are aligned in the process. The alignment of the sheets 09 on the leading-edge stop 13 here is assisted by the inclination of the supporting table 11 in the direction of the leading-edge stop 13, since the weight-induced forces acting on the sheets 09 are divided up into a horizontally acting and a vertically acting component in accordance with the angle of inclination of the supporting table 11. In order for it to be possible to vary the weight-induced forces acting on the sheet 09, it is thus particularly advantageous if it is possible to change the angle of inclination of the supporting table 11.

Continuous feeding of the sheets 09 from the stack 03 on the carrying plate 02, a stack 14 of sheets 09 arranged one above the other forms on the supporting table 11, the leading edges of these sheets being aligned on the leading-edge stop 13 in each case. The sequence of the sheets 09 here is maintained on account of the underlap imbrication of the imbricated stream.

The sheet 09 which is to be aligned has to be pushed in beneath the stack 14 of already aligned sheets 09. In this case, the thicker the stack 14 already is, the higher are the weight-induced forces which act on the sheet 09 which is to be aligned in each case. In order to prevent those frictional forces between the stack 14 and the top side of the sheet 09 to be aligned in each case which counteract the aligning movement of the sheet 09 which is to be aligned in each case from becoming inadmissibly high, it is possible to provide on the apparatus 01 a blowing means 16, which blows air, in particular ionized air, from the trailing edge of the aligned sheet 09, between the respectively foremost sheet 09 of the imbricated stream and the stack 14. As a result, an air cushion is thus formed between the stack 14 and the next sheet 09 which is to be aligned in each case, and the friction is reduced correspondingly.

Figure 2:
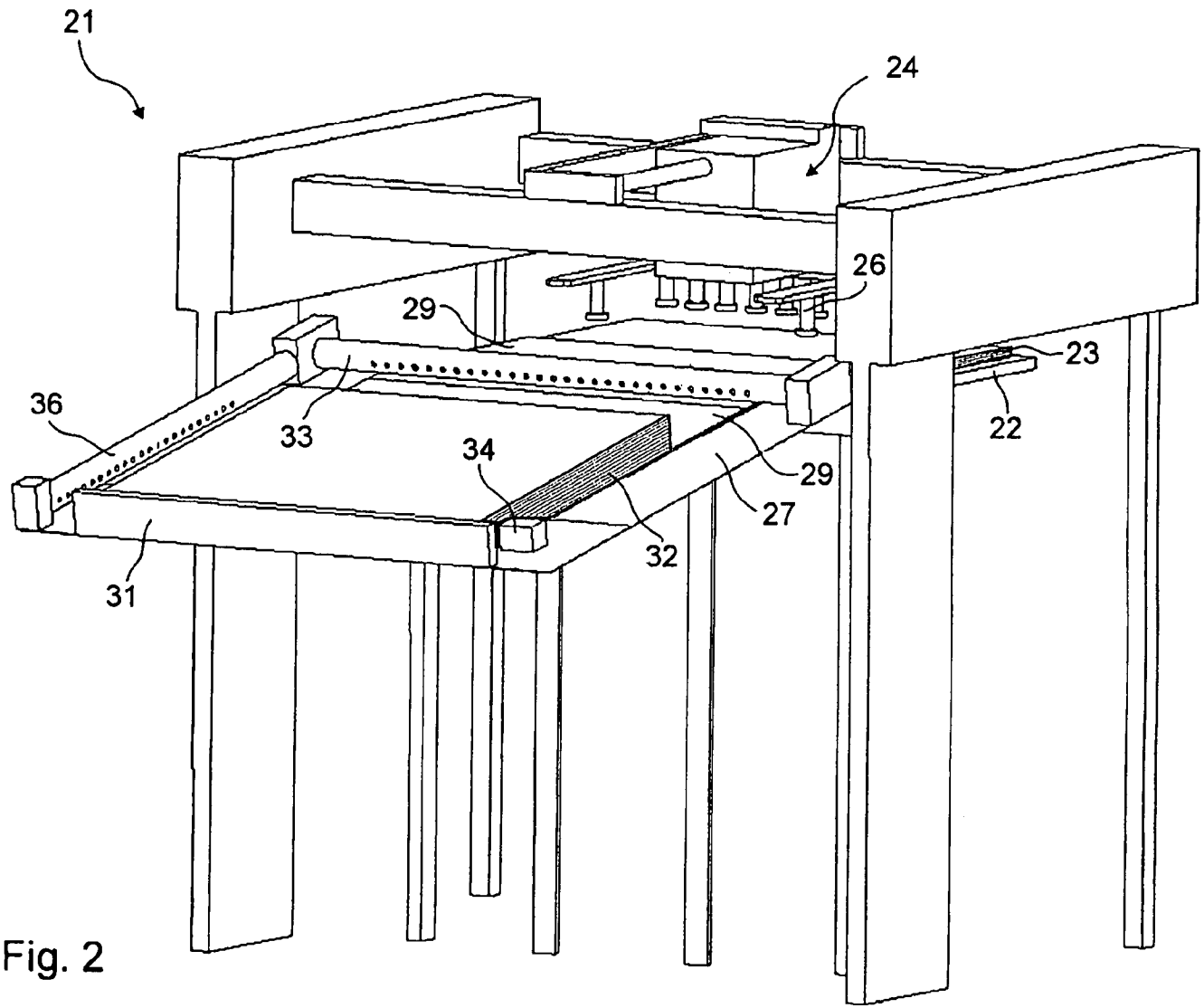
FIG. 2 shows a second exemplary embodiment of an apparatus in a schematically illustrated perspective view.

FIG. 2 illustrates a second exemplary embodiment of an apparatus 21 in a perspective view as seen obliquely from above. The apparatus 21 has a carrying plate 22, on the top side of which it is possible to set down a stack 23 of sheets 29 with non-aligned leading edges. Arranged above the carrying plate 22 is a suction means 24 which can be displaced along three axes and of which the suction cups 26 can be brought into abutment against the top side of the respectively uppermost sheet 29 of the stack 23. By virtue of a corresponding conveying movement of the suction cups 26, the respectively uppermost sheet 29 of the stack 23 can be raised up individually and conveyed in the direction of the supporting table 27. The suction means 24 here executes a conveying movement, with the result that the sheets 29 are consequently conveyed from the stack 23 in the direction of the supporting table 27 in an imbricated stream with underlap imbrication.

The supporting table 27 is designed as a suction-belt table 27 with suction belts 28 (see FIG. 3), with the result that, following separation on the top side of the supporting table 27, the sheets 29 are conveyed in the direction of a leading-edge stop 31 and are aligned by abutment against the same.

The leading-edge stop 13; 31 can be adjusted to the shape of the leading edge of the sheets 09; 29, in particular in convex, concave or sloping form.

Continuous conveying of the sheets 29 with underlap imbrication on the supporting table 27 results in the formation of a stack 32 of sheets 29 with their leading edges aligned in each case on the leading-edge stop 31. In order to assist the sheet 29 which is to be aligned in each case in being conveyed beneath the stack 32, a blowing device 33 is provided, this having a multiplicity of blowing nozzles from which it is possible to blow ionized air into the region between the stack 32 and the respectively foremost sheet 29 of the imbricated stream which is to be aligned.

In order for it also to be possible to align the side edges of the sheets 29 in the apparatus 21, there is provided a side-edge stop 34, which can be adjusted to the format of the sheets 29 and against which the side edges of the sheets 29 can be brought into abutment and thus aligned. In order to assist the aligning movement of the sheets 29 on the side-edge stop 34, a further blowing device 36 is provided, by means of which it is possible to blow ionized air, from that side of the sheets 29 which is located opposite the side-edge stop 34, between the stack 32 and the respectively lowermost sheet 29 which is to be aligned.

Figure 3:
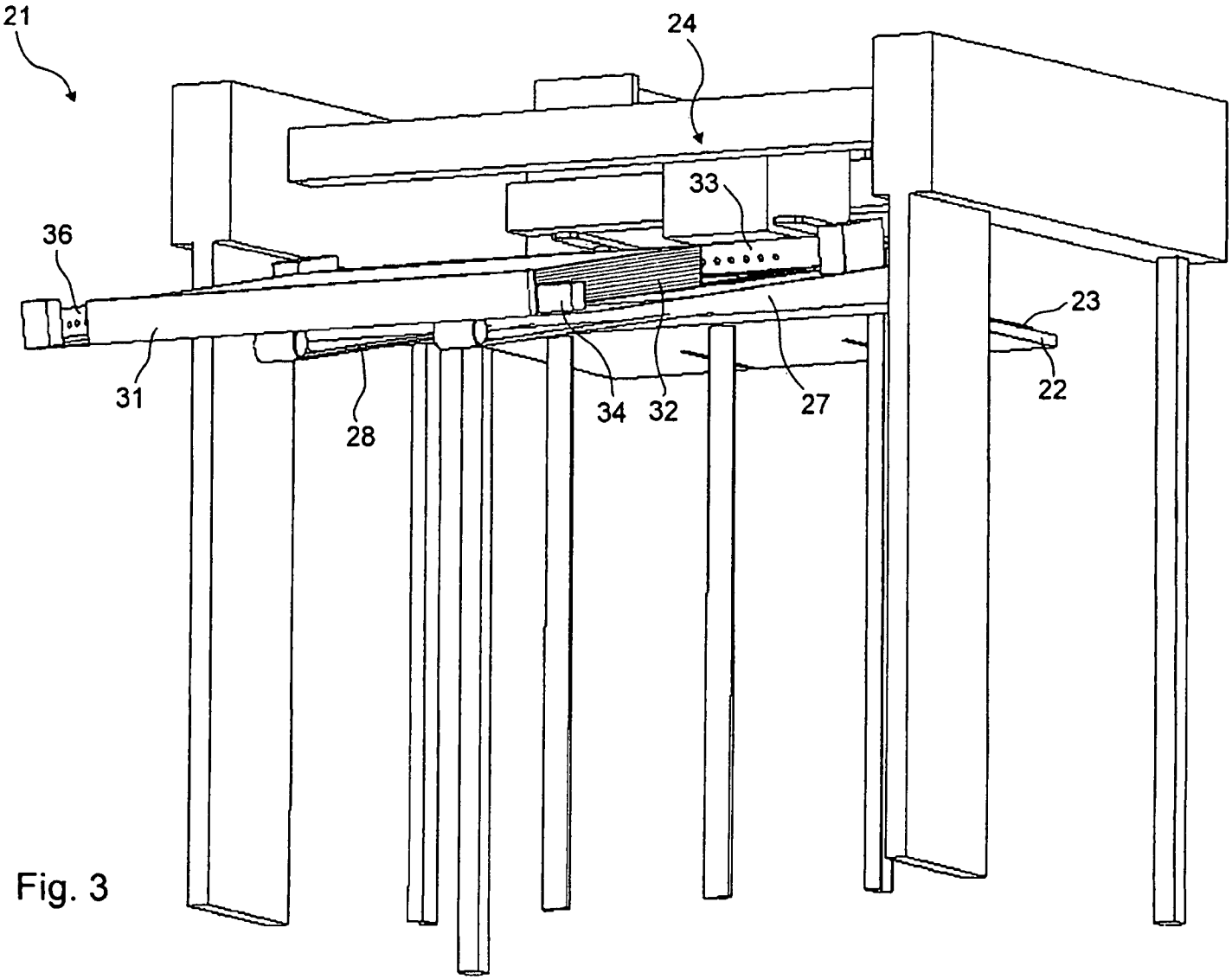
FIG. 3 shows the apparatus according to FIG. 2 in a further perspective view.

FIG. 3 illustrates the apparatus 21 in a further perspective view from beneath, it being possible, once again, to see the various components of the apparatus 21.

Figure 4:
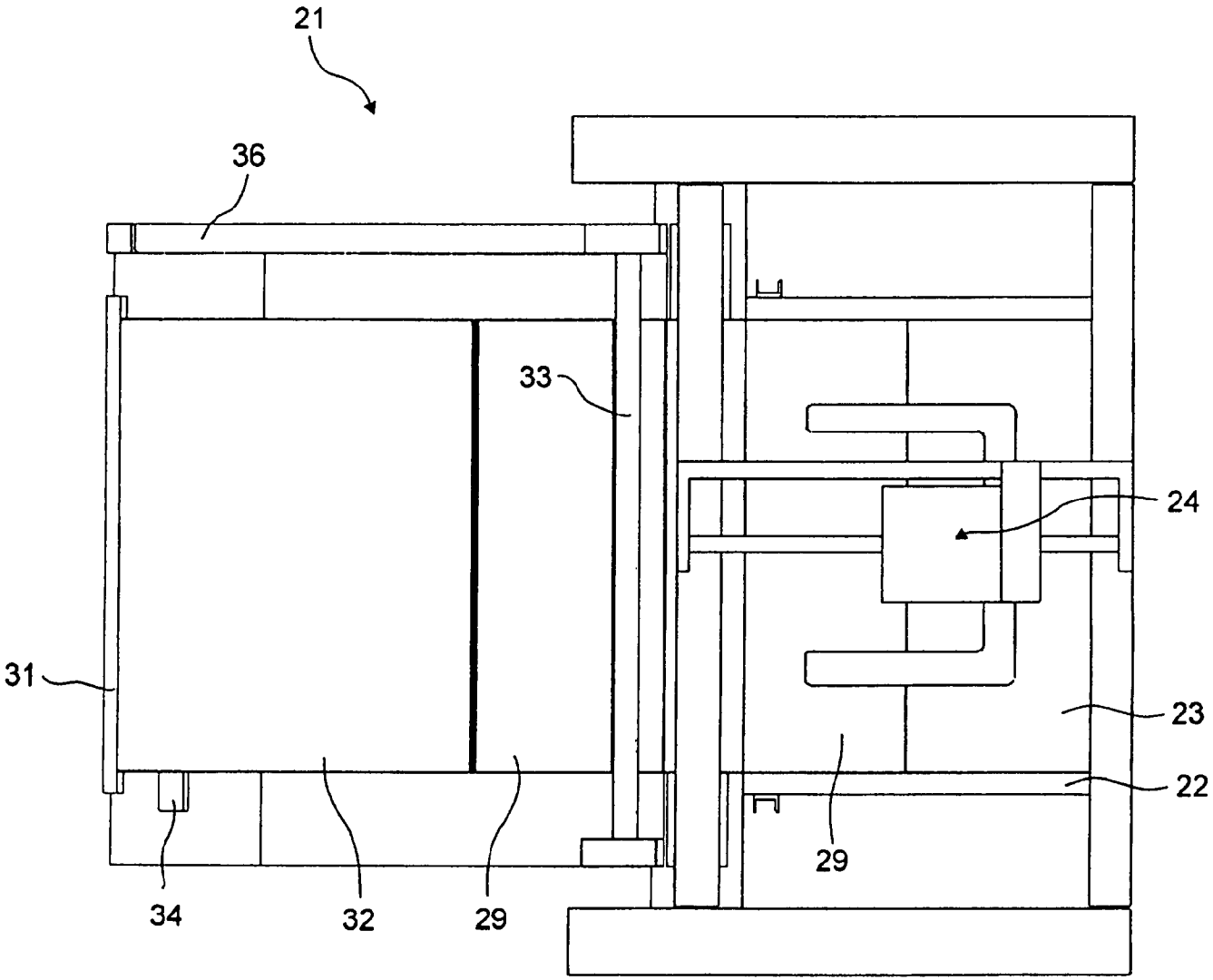
FIG. 4 shows the apparatus according to FIG. 2 in a view from above.

FIG. 4 illustrates the apparatus 21 with its various components in a view from above.

LIST OF DESIGNATIONS

| | |
|---|---|
| 01 | Apparatus |
| 02 | Carrying plate |
| 03 | Stack with non-aligned leading edges (09) |
| 04 | Sucker |
| 05 | — |
| 06 | Sucker |
| 07 | Stop |
| 08 | Pressure-exerting foot |
| 09 | Sheet |
| 10 | — |
| 11 | Supporting table, suction-belt table |
| 12 | Suction belt |
| 13 | Leading-edge stop |
| 14 | Stack with aligned leading edges (09) |
| 15 | — |
| 16 | Blowing device |
| 17 to 20 | — |
| 21 | Apparatus |
| 22 | Carrying plate |
| 23 | Stack with non-aligned leading edges (29) |
| 24 | Suction means |
| 25 | — |
| 26 | Suction cup |
| 27 | Supporting table, suction-belt table |
| 28 | Suction belt |
| 29 | Sheet |
| 30 | — |
| 31 | Leading-edge stop |
| 32 | Stack with aligned leading edges (29) |
| 33 | Blowing device |
| 34 | Side-edge stop |
| 35 | — |
| 36 | Blowing device |

The invention claimed is:

1. An apparatus for aligning at least one edge of a plurality of sheets arranged one above the other in a stack, while maintaining the sequence of the sheets, said apparatus comprising:

a supporting table with a leading-edge stop for aligning a leading edge of the sheets;

a carrying plate, arranged upstream of the supporting table, on which carrying plate the sheets are set down in a stack with unaligned leading edges; and a sheet feeder configured to convey the sheets in the form of an imbricated stream with underlap imbrication from the carrying plate to the leading-edge stop of the supporting table to form a stack of aligned sheets;

wherein said apparatus further comprises at least one blowing device for blowing air from the trailing edge of the sheets, between the conveyed sheets of the imbricated stream and the sheets of the stack of aligned sheets which are already aligned against the leading-edge stop of the supporting table.

2. The apparatus as claimed in claim 1, wherein the supporting table is designed in a manner of a suction-belt table for conveying a lowermost sheet of the imbricated stream of sheets against the leading-edge stop of the supporting table.

3. The apparatus as claimed in claim 2, wherein said supporting table comprises suction belts which are arranged beneath the stack of aligned sheets which is to be formed on the supporting table.

4. The apparatus as claimed in claim 1, wherein the supporting table is inclined downward in the direction of the leading-edge stop.

5. The apparatus as claimed in claim 4, wherein an angle of inclination of the supporting table in the direction of the leading-edge stop is adjustable.

6. The apparatus as claimed in claim 1, wherein the leading-edge stop is height-adjustable.

7. The apparatus as claimed in claim 1, wherein the leading-edge stop can be adjusted to the shape of the leading edge of the sheets.

8. The apparatus as claimed in claim 1, wherein a side-edge stop is provided on the supporting table for aligning a side-edge of the sheets.

9. The apparatus as claimed in claim 8, wherein the side-edge stop is adjustable to the format of the sheets.

10. The apparatus as claimed in claim 8, wherein the supporting table is inclined downward in the direction of the side-edge stop.

11. The apparatus as claimed in claim 10, wherein an angle of inclination of the supporting table in the direction of the side-edge stop is adjustable.

12. The apparatus as claimed in claim 8, further comprising a further blowing device for blowing air from a side edge of the sheets which is located opposite the side-edge stop, between the conveyed sheets of the imbricated stream and the sheets of the stack of aligned sheets which are already aligned against the side-edge stop of the supporting table.

13. The apparatus as claimed in claim 1, wherein said sheet feeder comprises a suction means for seizing an uppermost sheet of the stack of sheets disposed on said carrying plate and conveying said uppermost sheet towards the supporting table.

14. An apparatus for aligning at least one edge of a plurality of sheets arranged one above the other in a stack, while maintaining the sequence of the sheets, said apparatus comprising:

a supporting table with a leading-edge stop for aligning a leading edge of the sheets;

a carrying plate, arranged upstream of the supporting table, on which carrying plate the sheets are set down in a stack with unaligned leading edges; and a sheet feeder configured to convey which the sheets in the form of an imbricated stream with underlap imbrication from the carrying plate to the leading-edge stop of the supporting table to form a stack of aligned sheets;

wherein said apparatus further comprises:

a side-edge stop provided on the supporting table for aligning a side-edge of the sheets; and at least one blowing device for blowing air from a side edge of the sheets which is located opposite the side-edge stop, between the conveyed sheets of the imbricated stream and the sheets of the stack of aligned sheets which are already aligned against the side-edge stop of the supporting table.

15. The apparatus as claimed in claim 14, wherein the supporting table is designed in a manner of a suction-belt table for conveying a lowermost sheet of the imbricated stream of sheets against the leading-edge stop of the supporting table.

16. The apparatus as claimed in claim 15, wherein said supporting table comprises suction belts which are arranged beneath the stack of aligned sheets which is to be formed on the supporting table.

17. The apparatus as claimed in claim 14, wherein the supporting table is inclined downward in the direction of the leading-edge stop.

18. The apparatus as claimed in claim 17, wherein an angle of inclination of the supporting table in the direction of the leading-edge stop is adjustable.

19. The apparatus as claimed in claim 14, wherein the leading-edge stop is height-adjustable.

20. The apparatus as claimed in claim 14, wherein the leading-edge stop can be adjusted to the shape of the leading edge of the sheets.

21. The apparatus as claimed in claim 14, wherein the supporting table is inclined downward in the direction of the side-edge stop.

22. The apparatus as claimed in claim 21, wherein an angle of inclination of the supporting table in the direction of the side-edge stop is adjustable.

23. The apparatus as claimed in claim 14, wherein the side-edge stop is adjustable to the format of the sheets.

24. The apparatus as claimed in claim 14, wherein said sheet feeder comprises a suction means for seizing an uppermost sheet of the stack of sheets disposed on said carrying plate and conveying said uppermost sheet towards the supporting table.

* * * * *

UNITED STATES PATENT AND TRADEMARK OFFICE

CERTIFICATE OF CORRECTION

PATENT NO. : 7,392,981 B2
APPLICATION NO. : 10/490504
DATED : July 1, 2008
INVENTOR(S) : Thilo Hahn and Johannes Georg Schaede It is certified that error appears in the above-identified patent and that said Letters Patent is hereby corrected as shown below:

Column 5
Line 39, delete “which”.

Signed and Sealed this

Sixteenth Day of September, 2008

JON W. DUDAS
*Director of the United States Patent and Trademark Office*